US009868603B2

(12) United States Patent
Ando et al.

(10) Patent No.: US 9,868,603 B2
(45) Date of Patent: Jan. 16, 2018

(54) SHEET PROCESSING APPARATUS AND IMAGE FORMING SYSTEM

(71) Applicant: CANON KABUSHIKI KAISHA, Tokyo (JP)

(72) Inventors: Yutaka Ando, Toride (JP); Akinobu Nishikata, Abiko (JP); Takashi Yokoya, Yoshikawa (JP); Akihiro Arai, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/205,366

(22) Filed: Jul. 8, 2016

(65) Prior Publication Data

US 2017/0031297 A1 Feb. 2, 2017

(30) Foreign Application Priority Data

Jul. 27, 2015 (JP) ..... 2015-147674

(51) Int. Cl.
*B65H 31/00* (2006.01)
*B65H 7/04* (2006.01)
(Continued)

(52) U.S. Cl.
CPC ..... *B65H 7/04* (2013.01); *B65H 7/14* (2013.01); *B65H 7/18* (2013.01); *B65H 7/20* (2013.01);
(Continued)

(58) Field of Classification Search
CPC ... B65H 7/02; B65H 7/04; B65H 7/06; B65H 7/14; B65H 7/18; B65H 7/20;
(Continued)

(56) References Cited

U.S. PATENT DOCUMENTS 4,523,832 A * 6/1985 Strutt ..... B25B 13/461 271/10.03
2009/0103962 A1* 4/2009 Fujii ..... B42C 5/02 399/404
(Continued)

FOREIGN PATENT DOCUMENTS

JP H10-279166 A 10/1998

*Primary Examiner* — Prasad V Gokhale
(74) *Attorney, Agent, or Firm* — Rossi, Kimms & McDowell LLP

(57) ABSTRACT

A sheet processing apparatus that is capable of facilitating a process by eliminating waste of a result even if a translucent sheet is conveyed. A conveyance unit conveys a sheet received from an image forming apparatus. An optical sensor detects a sheet end conveyed. An alignment unit aligns sheets based on information detected by the optical sensor. A post-process unit performs a post-process to the sheets aligned. An input unit inputs sheet information about a type of the sheet to be received from the image forming apparatus. A control unit stops sheet conveyance when the sheet information indicates a first type sheet and when the optical sensor cannot detect the sheet end, and continues sheet conveyance when the sheet information indicates a second type sheet of which transmittance is higher than the first type sheet and when the optical sensor cannot detect the sheet end.

12 Claims, 12 Drawing Sheets

(51) Int. Cl.

| | |
|---|---|
| ***G03G 15/00*** | (2006.01) |
| ***B65H 7/14*** | (2006.01) |
| ***B65H 7/18*** | (2006.01) |
| ***B65H 7/20*** | (2006.01) |

(52) U.S. Cl.
CPC ... *G03G 15/6541* (2013.01); *B65H 2401/222* (2013.01); *B65H 2701/1712* (2013.01)

(58) Field of Classification Search
CPC ..... B65H 29/12; B65H 29/125; B65H 2401/222; B65H 2701/1712; G03G 15/6541
See application file for complete search history.

(56) References Cited

U.S. PATENT DOCUMENTS

| | | | | |
|---|---|---|---|---|
| 2012/0043713 | A1* | 2/2012 | Maenishi | G03G 15/6541 270/45 |
| 2012/0250038 | A1* | 10/2012 | Uchino | B41J 11/006 358/1.5 |
| 2013/0127107 | A1* | 5/2013 | Goto | B65H 5/06 271/9.01 |
| 2013/0193630 | A1* | 8/2013 | Ando | G03G 15/6544 270/58.07 |
| 2015/0277321 | A1* | 10/2015 | Nonaka | G03G 15/50 399/82 |
| 2015/0310316 | A1* | 10/2015 | Osada | G06K 15/16 358/1.12 |
| 2016/0376116 | A1* | 12/2016 | Suzuki | B65H 7/06 271/262 |

* cited by examiner

*FIG. 5*

| SENSOR | POSSIBLE/IMPOSSIBLE |
|---|---|
| 570 | POSSIBLE |
| 571 | POSSIBLE |
| 572 | IMPOSSIBLE |
| 573 | IMPOSSIBLE |
| 574 | POSSIBLE |
| 575 | IMPOSSIBLE |
| 576 | POSSIBLE |

*FIG. 8*

| |
|---|
| SHEET ID |
| SHEET WIDTH [mm] |
| SHEET LENGTH [mm] |
| SHEET WEIGHT [gsm] |
| SHEET TYPE |
| POST-PROCESS MODE |
| ⋮ |

SHEET PROCESSING APPARATUS AND IMAGE FORMING SYSTEM

BACKGROUND OF THE INVENTION

Field of the Invention

The present invention relates to a sheet processing apparatus that applies a post process to a sheet output from an image forming apparatus, and to an image forming system that is provided with the sheet processing apparatus.

Description of the Related Art

There is a known sheet processing apparatus that is arranged at a downstream side of an image forming apparatus, such as a copying machine and a printer, applies a post process, such as a binding process, to a sheet (paper) output from an image forming apparatus, and conveys and aligns a transparent sheet with high transmittance, such as an OHP sheet, or a translucent sheet.

When a sheet processing apparatus performs post processes including a binding process, an alignment member is operated in synchronization with conveyance of a sheet in order to raise quality of a result. For example, there is a known technique that corrects conveyance error for every sheet by operating an alignment member in synchronizing with a detection of a sheet end detected by a detection sensor that detects an end of a sheet conveyed by conveying rollers (Japanese Laid-Open Patent Publication (Kokai) No. H10-279166 (JP H10-279166A)).

Incidentally, there is an increasing demand to perform a printing process and a post process to a translucent sheet of which transmittance is high but is not as high as an OHP sheet in recent years.

Although an optical sensor with high detection accuracy, such as a transmission optical sensor, is employed as a conveyance sensor in order to detect a position of a conveyed sheet correctly, the transmission-optical sensor may not correctly detect a translucent sheet with high transmittance. In this case, since the sheet end is not detected even if predetermined time passes from a predetermined timing, a conveyance jam is erroneously determined, and the conveyance of sheet is stopped on the basis of the erroneous determination. This wastes the results and delays the process.

SUMMARY OF THE INVENTION

The present invention provides a sheet processing apparatus and an image forming system that are capable of facilitating a process by eliminating waste of a result even if a translucent sheet of which a sheet end cannot be detected by a sheet detection unit is conveyed.

Accordingly, a first aspect of the present invention provides a sheet processing apparatus including a conveyance unit configured to convey a sheet received from an image forming apparatus along a conveyance path, an optical sensor configured to be provided on the conveyance path and to detect the end of the sheet during conveyance, an alignment unit configured to align sheets conveyed by the conveyance unit based on detection information about the end of the sheet by the optical sensor, a post-process unit configured to perform a post-process to the sheets aligned by the alignment unit, an input unit configured to input sheet information about a type of the sheet to be received from the image forming apparatus, and a control unit configured to control the conveyance unit so as to stop a sheet conveyance operation when the sheet information input with the input unit indicates a first type sheet and when the optical sensor cannot detect the end of the sheet during conveyance, and to control the conveyance unit so as to continue the sheet conveyance operation when the sheet information input with the input unit indicates a second type sheet of which transmittance is higher than the first type sheet and even when the optical sensor cannot detect the end of the sheet during conveyance.

Accordingly, a second aspect of the present invention provides an image forming system including an image forming apparatus configured to form an image on a sheet, and the sheet processing apparatus of the first aspect that performs a post-process to the sheet received from the image forming apparatus.

According to the present invention, even if the sheet detection unit cannot detect the sheet end during the conveyance process of the translucent sheet, it is determined whether the sheet conveyance continues according to whether a post-process will be performed. Since this enables to continue the conveyance when a post-process will not be performed, the process is facilitated by eliminating waste of the result.

Further features of the present invention will become apparent from the following description of exemplary embodiments with reference to the attached drawings.

BRIEF DESCRIPTION OF THE DRAWINGS

FIG. 5 is a view showing detection capabilities of conveyance sensors for a transparent sheet.

FIG. 8 is a view showing a format of the sheet information transmitted from the controller to a finisher control unit.

DESCRIPTION OF THE EMBODIMENTS

Hereafter, embodiments according to the present invention will be described in detail with reference to the drawings.

Figure 1:
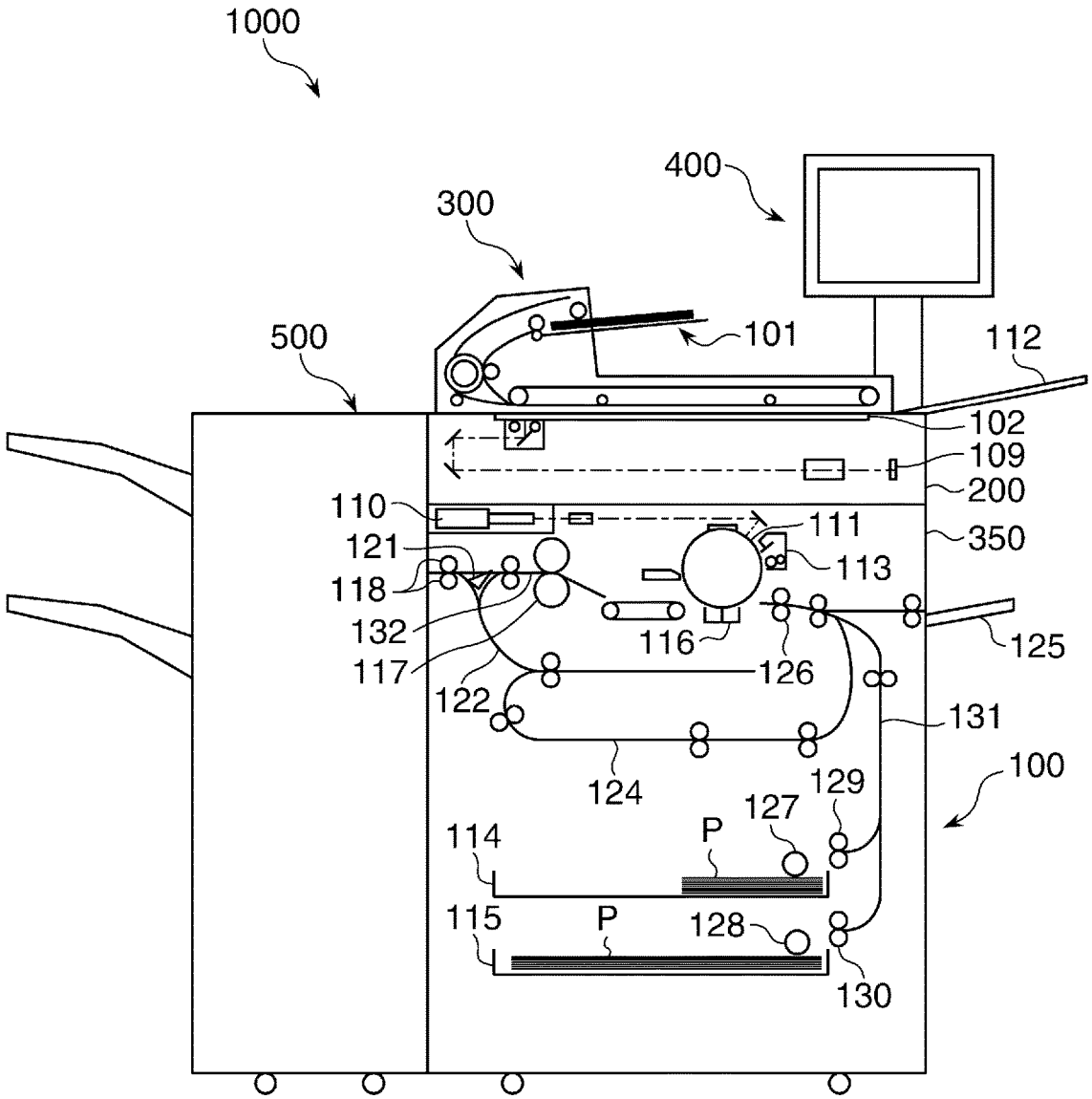
FIG. 1 is a sectional view schematically showing a configuration of an image forming system equipped with a sheet processing apparatus according to an embodiment.

FIG. 1 is a sectional view schematically showing a configuration of an image forming system equipped with a sheet processing apparatus according to an embodiment.

As shown in FIG. 1, the image forming system 1000 mainly consist of an image forming apparatus 100, a sheet processing apparatus (finisher) 500, and an operation display unit 400. The image forming apparatus 100 is provided with an image reading device (image reader) 200 that reads an original, an original feeder 300 that feeds an original to the image reader 200, and a printer 350 that forms an image on a sheet according to image data.

The original feeder 300 is provided with an original tray 101, a platen glass 102, and a sheet ejection tray 112. The original feeder 300 feeds originals set upward on the original tray 101 one by one from the top page leftward in FIG. 1, and conveys an original via a curved path and over a platen glass 102 from left to right via a reading position. Then, the original is ejected to the sheet ejection tray 112.

The image reader 200 reads an original image with an image sensor 109, when an original passes through the predetermined image reading position on the platen glass 102 from right to left in FIG. 1. The image read with the image sensor 109 is output to an exposure device of the printer 350 as a video signal.

Next, the configuration of the printer 350 will be described.

The printer 350 is provided with an image forming unit, a conveyance path that conveys a sheet P as a recording sheet to the image forming unit, and a sheet container unit that stores the sheets P. The image forming unit is provided with a photosensitive member 111 as an image bearing member, the exposure device 110 that exposes and forms an electrostatic latent image on the photosensitive member 111, a development device 113 that develops the electrostatic latent image with toner, and a transfer unit 116 that transfers the toner image on the photosensitive member 111 to the sheet P. The sheet container unit consists of an upper cassette 114, a lower cassette 115, and a manual sheet feeding unit 125. The conveyance path is provided with a feed path 131 that conveys the sheet P from the upper cassette 114 or the lower cassette 115 to the transfer unit 116, and an ejection path 132 that ejects the sheet P after forming the image outside the apparatus via the fixing device 117. An inversion path 122 is connected to the downstream side of the fixing device 117 of the ejection path 132, and a double-sided conveyance path 124 is connected to the inversion path 122.

The feed path 131 is provided with pickup rollers 127 and 128 and feed roller pairs 129 and 130 respectively corresponding to the upper cassette 114 and the lower cassette 115, and a registration roller pair 126. A flapper 121 is arranged at a bifurcation of the ejection path 132 and the inversion path 122. An ejection roller pair 118 that ejects the sheet P toward the finisher 500 at the downstream side is arranged in the ejection path 132.

In the printer 350 of such a configuration, the exposure device 110 forms an electrostatic latent image according to a video signal by exposure scanning the surface of the photosensitive member 111. The development device 113 supplies toner as developer to the electrostatic latent image formed on the photosensitive member 111 and visualizes as a toner image.

On the other hand, the sheet P fed from the upper cassette 114 or the lower cassette 115 is conveyed by the feed roller pair 129 or 130 to the registration roller 126 that is suspended. When the sheet P reaches the registration roller 126, the finisher 500 that is a downstream apparatus is notified of sheet information of the sheet P. The sheet information includes a sheet size, basis weight, type of sheet material, post-processing mode, etc. The finisher 500 stores the received sheet information in a RAM 954 mentions later.

After the sheet P contacted the registration roller pair 126 at the front end and stopped, the registration roller pair 126 conveys the sheet P to the transfer unit 116 at a timing in synchronization with an irradiation start of a laser beam. The toner image formed on the photosensitive member 111 is transferred to the sheet P with the transfer unit 116. The sheet P on which the toner image was transferred is conveyed into the fixing device 117. The fixing device 117 fixes the toner image to the sheet P by heating and pressurizing the sheet P. The sheet P ejected from the fixing device 117 is ejected towards the finisher 500 through the flapper 121 and the ejection roller pair 118, for example.

When the sheet P is ejected with the image formation side down (face down), the sheet P passed through the fixing unit 117 is once guided in the inversion path 122 by a switching operation of the flapper 121. Then, after the rear end of the sheet P passed the flapper 121, the sheet P is switched back and is ejected by the ejection roller 118.

On the other hand, when two-sided printing that forms images on both sides of the sheet P is performed, after the sheet P to which the image was formed on the first side was guided to the inversion path 122 by a switching operation of the flapper 121, the sheet P is switched back and is conveyed to the double-sided conveyance path 124. Then, the sheet P is conveyed to the transfer unit 116 again, and an image is formed on the second side of the sheet P.

Figure 2:
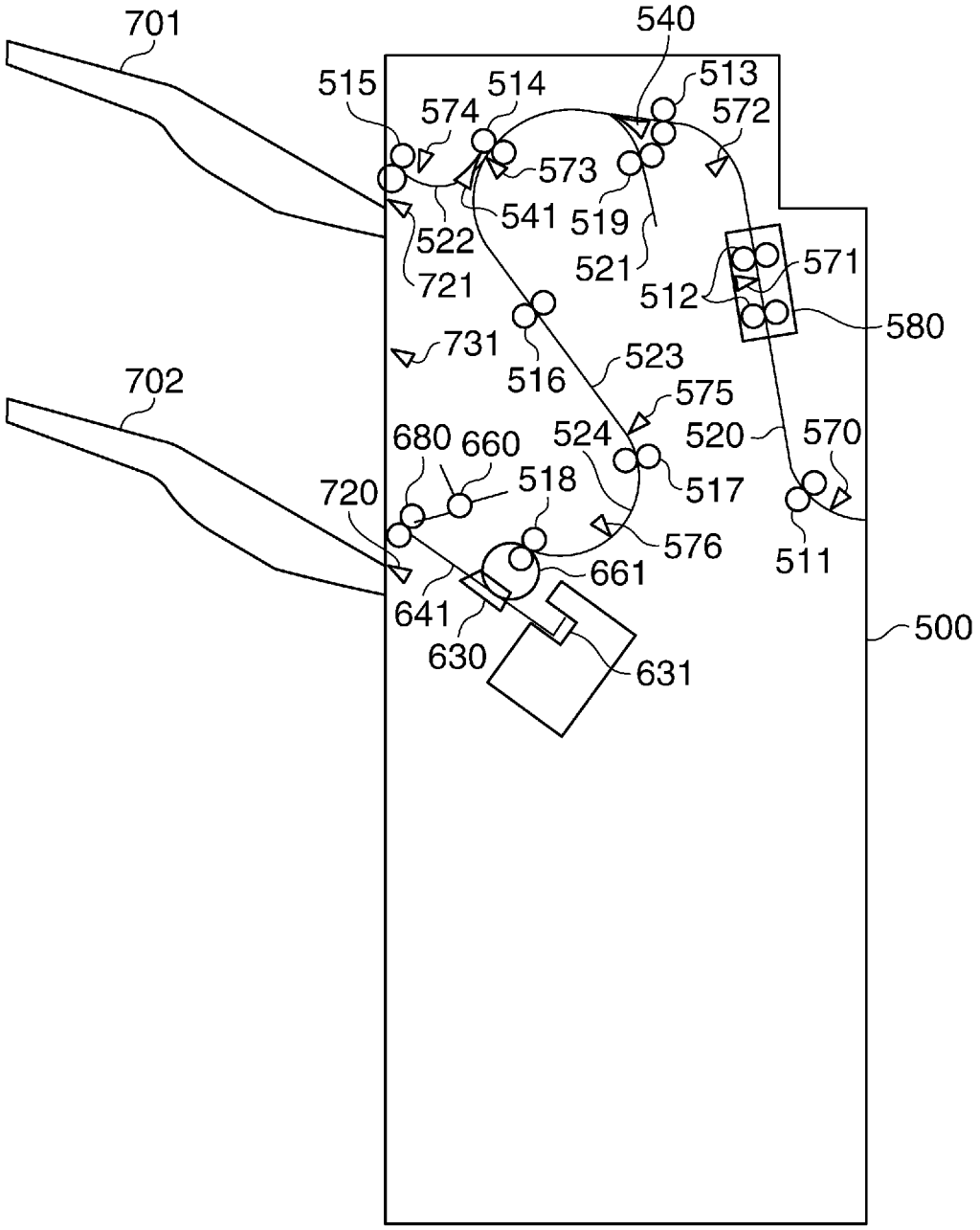
FIG. 2 is a sectional view schematically showing a configuration of a finisher shown in FIG. 1.

Next, the configuration of the finisher 500 will be described. FIG. 2 is a sectional view schematically showing the configuration of the finisher 500 shown in FIG. 1.

As shown in FIG. 2, the finisher 500 has a conveyance path that applies various processes to the sheet P ejected from the image forming apparatus 100 and conveys it to an upper sheet ejection tray 701 or a lower sheet ejection tray 702. That is, the finisher 500 is provided with a conveyance path 520 that conveys the sheet P received from the image forming apparatus 100 to a conveying roller pair 514 at the upstream side of the upper sheet ejection tray 701 through a shift unit 580. The finisher 500 is provided with an upper sheet ejection path 522 that conveys the sheet P conveyed to the conveying roller pair 514 and ejects the sheet P to the upper sheet ejection tray 701 as stack means and a lower sheet ejection path 523 that conveys the sheet P to a processing tray 641 as middle stack means.

A conveyance sensor 570, conveying roller pair 511, and the shift unit 580 are provided along the conveyance path 520 in the conveyance direction of the sheet P. The shift unit 580 is movable in a sheet width direction perpendicular to the conveyance direction with a below-mentioned shift motor M4 to correct the position of the sheet P in the sheet width direction. First and second conveyance roller pairs 512 are provided in the shift unit 580, and a conveyance sensor 571 is arranged between the first and the second conveyance roller pairs 512.

A conveyance sensor 572 and conveying roller pair 513 are arranged along the conveyance path 520 at the downstream side of the shift unit 580. A buffer path 521 with a conveying roller pair 519 is branched from the conveyance path 520 at the downstream side of the conveying roller pair 513. A flapper 540 is provided at the branch point. The flapper 540 guides the sheet that is conveyed inversely with the conveying roller 514 to the buffer path 521.

The conveyance path 520 is branched to the upper sheet ejection path 522 and the lower sheet ejection path 523 at the downstream side of the branch point of the buffer path 521. A flapper 541 is provided in the branch point of the upper sheet ejection path 522 and the lower sheet ejection path 523. A conveyance sensor 574 and a conveying roller pair 515 are provided in the upper sheet ejection path 522 between the flapper 541 and the upper sheet ejection tray 701. Conveying roller pairs 516, 517, and 518, and conveyance sensors 575 and 576 are provided in the lower sheet ejection path 523 between the flapper 541 and the processing tray 641. A stapler 631 and an alignment member 630 are provided in a processing tray 641. A conveyance path at the downstream side of the processing tray 641 extends to the lower sheet ejection tray 702. A bundle ejection roller pair 680 and a paddle 660 are provided in the conveyance path at the downstream side of the processing tray 641.

In such a configuration, the finisher 500 takes in the sheets P ejected from the image forming apparatus 100 in order, and performs various post-processes, such as a bundling process that aligns and bundles the sheets P taken in, a staple process that binds the sheet bundle with a staple.

The sheet P that was ejected from the image forming apparatus 100 and reached to the entrance of the finisher 500 is detected by the conveyance sensor 570, and is taken into the conveyance path 520 by the conveying roller pair 511. The sheet P taken into the conveyance path 520 is further conveyed by the conveying roller pair 511, and its lateral-end position is detected by a lateral deviation detection sensor (not shown). This enables to detect the deviation of the position of the sheet P in its width direction (lateral deviation amount) from the center position of the conveying width of the conveyance path 520.

The lateral deviation of the sheet P is corrected by the shift unit 580.

The shift unit 580 is able to move the sheet P in the sheet width direction that is perpendicular to the conveyance direction with the below-mentioned shift motor M4. The shift unit 580 offsets in the width direction by driving the shift motor M4 while the conveying roller pairs 512 hold and convey the sheet P. When a user selects a "shift" in a sorting mode (see FIG. 6B mentioned below), and when the sheet shifts frontward when viewing the image forming apparatus from the front (front shift), the sheet P is offset frontward by 15 mm, for example. When the sheet shifts backward when viewing the image forming apparatus from the front (back shift), the sheet P is offset backward by 15 mm, for example. When the "shift" is not selected, the shift unit 580 makes the sheet pass as-is without offsetting. When the conveyance sensor 571 detects that the sheet P passed the shift unit 580, the shift motor M4 is driven to return the shift unit 580 to the center position.

The sheet P that was shifted by the predetermined amount to correct the lateral deviation is conveyed by the conveying roller pairs 512, 513, and 514 in the conveyance direction. The sheet P is ejected onto the upper sheet ejection tray 701 through the upper sheet ejection path 522 by means of the flapper 541, and is stacked, for example. That is, when the flapper 541 is switched to the side of the upper sheet ejection path 522, the sheet P is guided to the upper sheet ejection path 522 by the conveying roller pair 514 driven with a buffer motor M2 mentioned below. Then, the sheet P is ejected to the upper sheet ejection tray 701 by the conveying roller pair 515 driven with an ejection motor M3. The conveyance sensor 574 is provided on the upper sheet ejection path 522, and detects passage of a sheet.

On the other hand, when the bundling process or the staple process is performed to the sheet P, the flapper 541 is switched to the side of the lower-sheet-ejection-path 523. When the flapper 541 is switched to the side of the lower sheet ejection path 523, the sheet P is guided to the lower sheet ejection path 523 by the conveying roller pair 514 driven with the buffer motor M2, and is conveyed by the conveying roller pair 516 driven with the ejection motor M3. The conveyance sensor 575 is provided on the lower sheet ejection path 523, and detects passage of the sheet P. The sheet P conveyed by the conveying roller pair 516 is guided to the processing tray 641 by the conveying roller pairs 517 and 518 driven with the ejection motor M3. In this case, the conveyance sensor 576 detects passage of the sheet P.

Each set of the plurality of sheets P conveyed to the processing tray 641 are aligned with the alignment member 630, and form a sheet bundle. Movement of the alignment member 630 is detected on the basis of detection of the sheet rear end by the conveyance sensor 575. The formed sheet bundle is brought into the stapler 631 and the staple process is performed, if needed. The sheet bundle after the staple process is ejected by the bundle ejection roller 680 onto the lower sheet ejection tray 702.

Next, the control configuration of the entire image forming system including the controller that manages control of the entire image forming system 1000 in FIG. 1 will be described.

Figure 3:
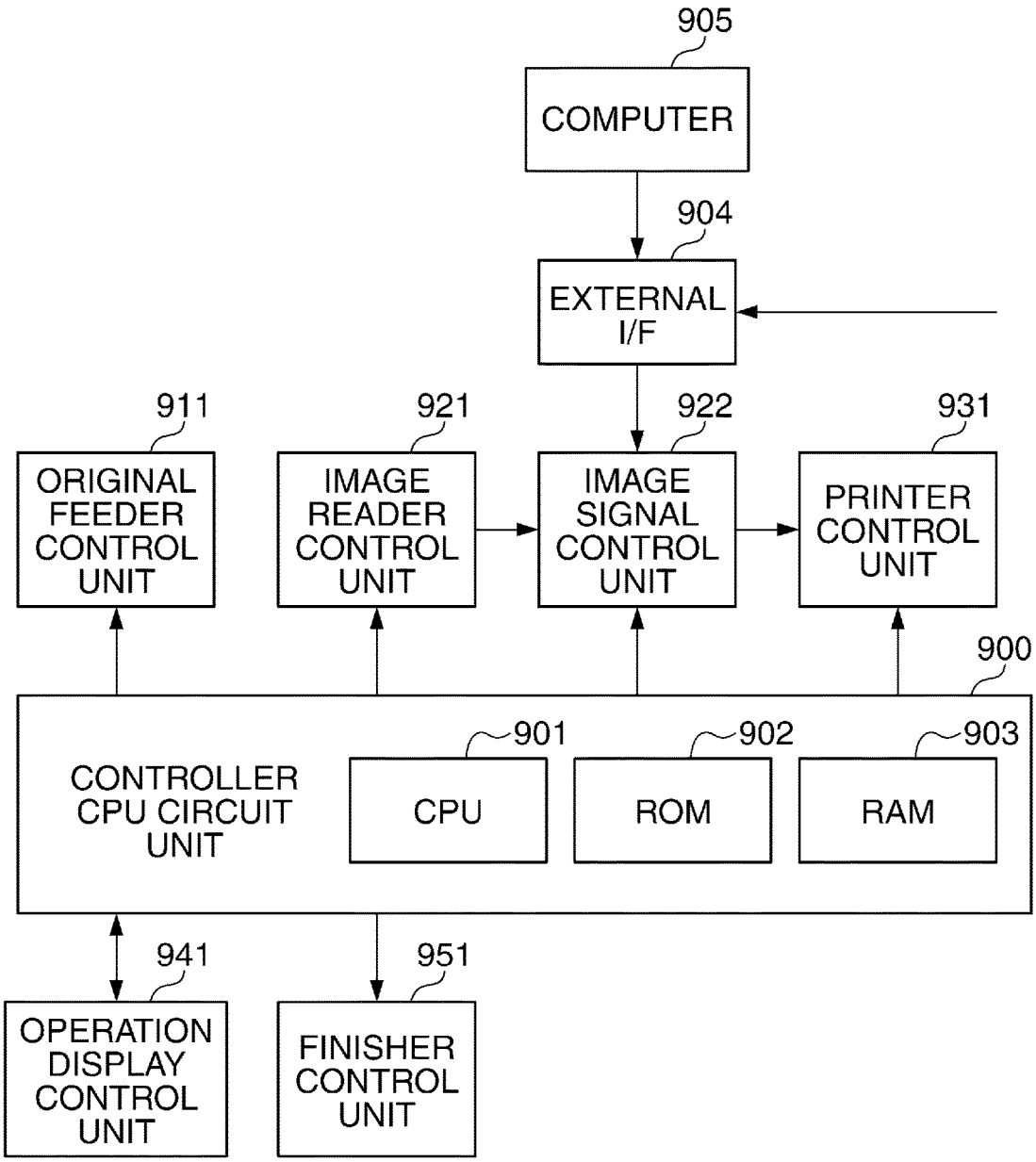
FIG. 3 is a block diagram schematically showing a control configuration of the image forming system.

FIG. 3 is a block diagram schematically showing the control configuration of the image forming system in FIG. 1.

As shown in FIG. 3, the image forming system 1000 is provided with a controller 900 as a control unit. The controller 900 contains a CPU 901, ROM 902, and RAM 903. The CPU 901 performs a basic control for the entire image forming system 1000. The CPU 901 is connected with the ROM 902 that stores a control program and the RAM 903 that is used for processing via a data bus (not shown).

The CPU 901 is connected with control units 911, 921, 922, 904, 931, 941, and 951, and controls them collectively according to the control program stored in the ROM 902. The control units includes an original feeder control unit 911, image reader control unit 921, image signal control unit 922, external I/F 904, printer control unit 931, operation display control unit 941, and finisher control unit 951. The RAM 903 stores control data temporarily, and is used as a working area of the arithmetic process accompanying control.

The original feeder control unit 911 controls the original feeder 300 on the basis of an instruction from the controller 900. The image reader control unit 921 drivingly controls the image sensor 109 mentioned above, and transfers an image signal output from the image sensor 109 to the image signal control unit 922.

The image signal control unit 922 converts the analog image signal from the image sensor 109 into a digital signal, applies various processes to the digital signal, converts the digital signal into a video signal, and outputs it to the printer control unit 931. Moreover, the image signal control unit 922 applies various processes to a digital image signal input from a computer 905 through the external I/F 904, converts the digital image signal into a video signal, and outputs it to the printer control unit 931. The process operation by the image signal control unit 922 is controlled by the controller 900. The printer control unit 931 controls the printer 350 to form an image and to convey a sheet on the basis of the input image signal.

The finisher control unit 951 is mounted on the finisher 500 and drivingly controls the entire finisher 500 by exchanging information with the controller 900. The control contents will be described below.

The operation display control unit 941 exchanges information between the operation display unit 400 and the controller 900. The operation display unit 400 has a plurality of keys for setting various functions about image formation, a display unit for displaying information showing set state, etc. The operation display unit 400 outputs a key signal corresponding to an operation of a key to the controller 900 and displays information corresponding to a signal from the controller 900 on the display unit.

Figure 4:
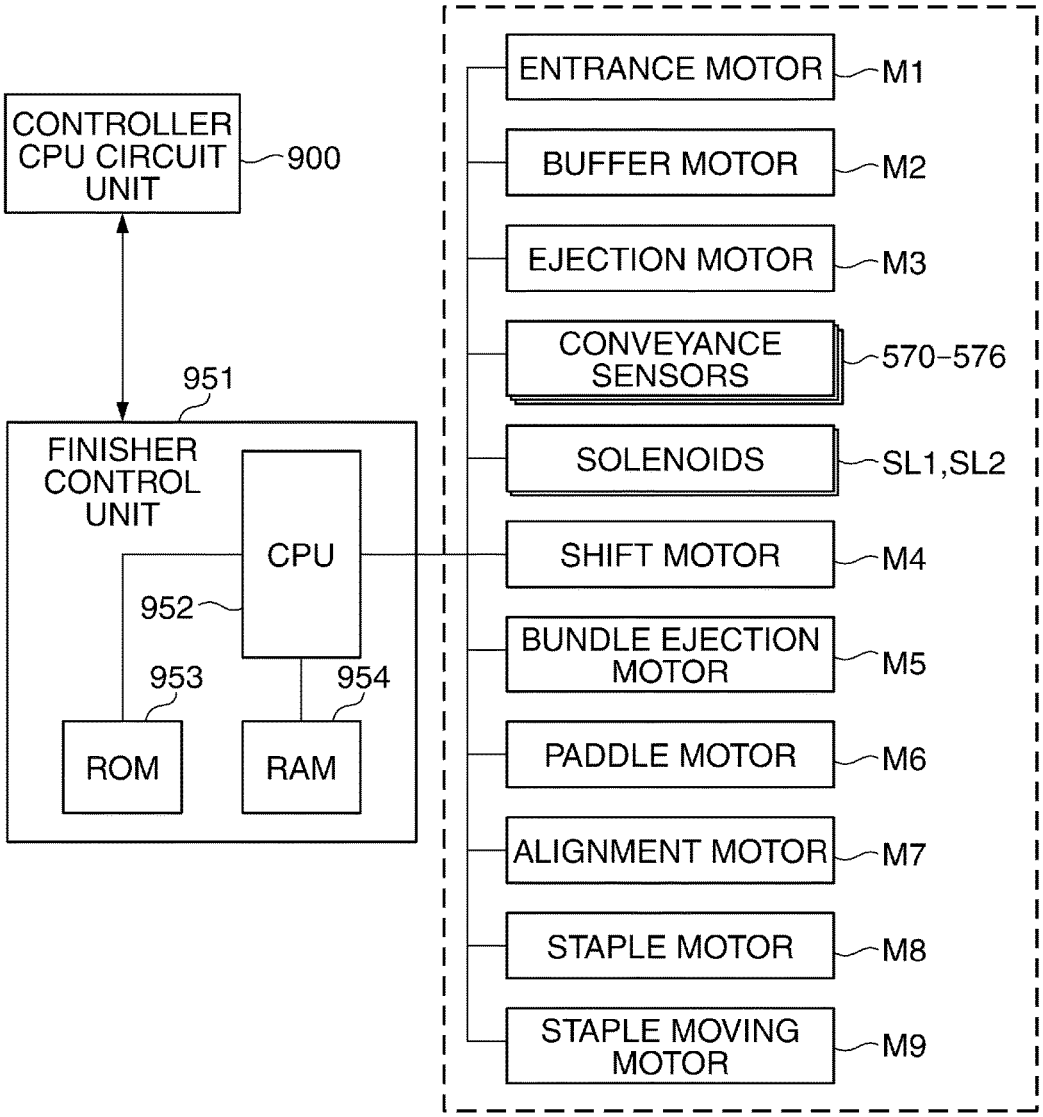
FIG. 4 is a block diagram schematically showing a configuration of a finisher control unit shown in FIG. 3.

Next, the configuration of the finisher control unit 951 in FIG. 3 will be described. FIG. 4 is a block diagram schematically showing a configuration of the finisher control unit 951 shown in FIG. 3.

As shown in FIG. 4, the finisher control unit 951 consists of a CPU 952, ROM 953, RAM 954, etc. The finisher control unit 951 is connected to the controller 900 provided in the image forming system 1000 through a communication IC, and exchanges data, such as job information and a sheet transfer notice, by communicating with the controller 900. That is, the finisher control unit 951 runs the various programs stored in the ROM 953 according to instructions from the controller 900, and controls various motors and sensors.

The CPU 952 of the finisher control unit 951 is connected to various motors, sensors, and solenoids SL1 and SL2 so as to be controllable. The motors include an entrance motor M1, the buffer motor M2, the ejection motor M3, the shift motor M4, a bundle ejection motor M5, a paddle motor M6, an alignment motor M7, a staple motor M8, and a staple moving motor M9. The sensors include the conveyance sensors 570 through 576.

The entrance motor M1 drives the conveying roller pairs 511, 512, and 513. The buffer motor M2 drives the conveying roller pairs 514 and 519. The ejection motor M3 drives the conveying roller pairs 515, 516, 517, and 518. The shift motor M4 drives the shift unit 580.

The bundle ejection motor M5 is a means for driving various members of the processing tray 641, and drives the bundle ejection roller pair 680. The paddle motor M6 drives the paddle 660. The alignment motor M7 drives the alignment member 630. The staple motor M8 drives the stapler 631 that performs a binding process (staple process) to a sheet bundle. The staple moving motor M9 moves the stapler 631 in the direction perpendicular to the conveyance direction along the outer periphery of the processing tray 641. The conveyance sensors 570 through 576 detect the sheet during conveyance.

A conveyance sensor belongs to a group that is able to detect a sheet end of a transparent sheet or to a group that is not able to detect a sheet end of a transparent sheet. In this embodiment, the conveyance sensors in both groups are employed. An optical sensor that has a light emitting element and a photo detector cannot detect a sheet end of a transparent sheet. Although the optical sensor is good in accuracy of sheet detection timing, it is sometimes difficult to detect a sheet end of a transparent sheet, such as a transparent OHP sheet and a translucent vellum sheet. On the other hand, a flag sensor is able to detect a sheet end of a transparent sheet, for example. Although the flag sensor detects a sheet end by detecting a position of a flag that is displaced by contact of a sheet, it is poorer than the optical sensor in the accuracy of sheet detection timing.

FIG. 5 is a view showing detection capabilities of conveyance sensors for a transparent sheet.

As shown in FIG. 5, the conveyance sensors 570, 571, 574, and 576 are able to detect a sheet end of a transparent sheet, and the conveyance sensors 572, 573, and 575 cannot detect a sheet end of a transparent sheet.

Next, the sheet conveyance process using the finisher 500 will be described. A user registers and sets out fundamental conditions of the image forming apparatus 100 and conditions of an image forming job using the operation display unit 400 as a premise of the sheet conveyance process.

Figure 6A:
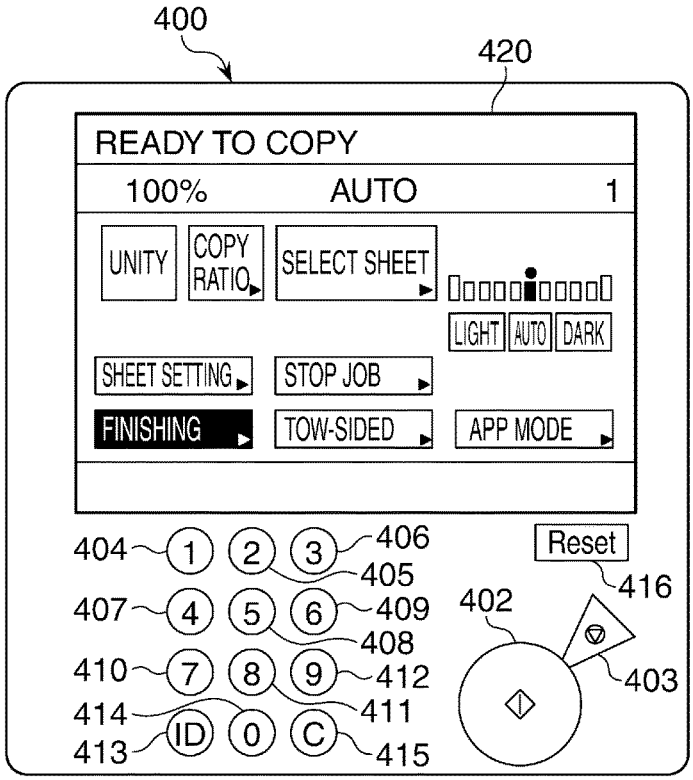
FIG. 6A through FIG. 6C are views for describing an operation display unit in the image forming system shown in FIG. 1.
Figure 6B:
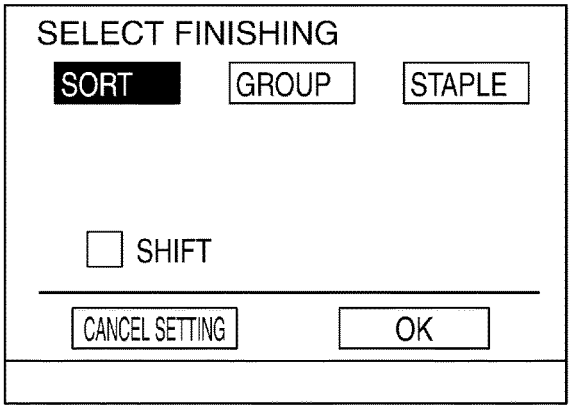
Figure 6C:
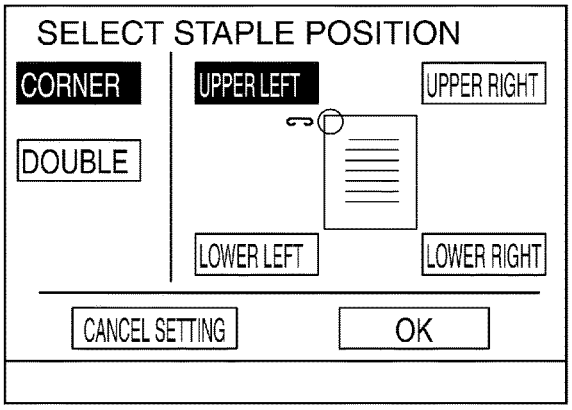

FIG. 6A through FIG. 6C are views for describing the operation display unit 400 in the image forming system shown in FIG. 1.

As shown in FIG. 6A, the operation display unit 400 is provided with a start key 402 for starting an image forming operation, a stop key 403 for interrupting the image forming operation, and numeral keys 404 through 412 and 414 for inputting numeric numbers. Moreover, an ID key 413, clear key 415, reset key 416, and user mode key (not shown) for setting various apparatuses are arranged in the operation display unit 400. Moreover, a display unit 420 that functions as a touch panel is arranged in the upper portion of the operation display unit 400, and soft keys are displayed on the display screen of the display unit 420.

In the image forming system 1000, the process mode is settable from among a non-sorting mode, sorting mode, shift sorting mode, and staple sorting mode (binding mode) as a post-process mode. A mode is set according to an input operation by a user through the operation display unit 400.

For example, when the user selects a soft key of "FINISHING" in an initial screen shown in FIG. 6A for setting up a post-process mode, a menu selection screen shown in FIG. 6B will be displayed on the display unit 420. The user is able to set up the process mode using the menu selection screen.

For example, when the user finishes the selection of the finishing (presses an OK button) after selecting a soft key of "SORT" in FIG. 6B, a sorting mode is set up. Moreover, when a soft key of "STAPLE" is pressed, a staple setting screen shown in FIG. 6C will be displayed on the display unit 420. The user is able to select a binding method from among a corner binding, two-place binding, etc.

When the soft key of "STAPLE" is selected, the "STAPLE" is set as the post-process mode in the sheet information of which the finisher 500 is notified from the image forming apparatus 100. The sheet information of which the finisher 500 is notified from the image forming apparatus 100 will be mentioned later.

Hereinafter, a method that the user sets the sheet information, such as a sheet size, sheet type, paper weight, using the operation display unit 400 will be described with reference to FIG. 7 through FIG. 7E.

FIG. 7A through FIG. 7E are views showing sheet information setting screens displayed on a display unit 420 of the operation display unit 400.

Figure 7A:
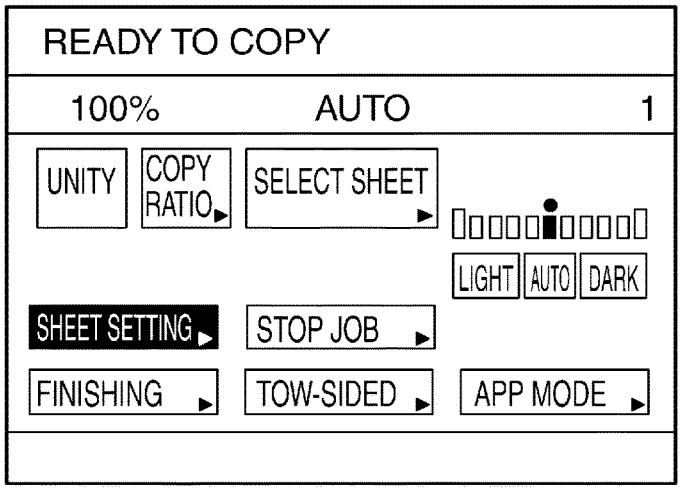
FIG. 7A through FIG. 7E are views showing sheet information setting screens displayed on a display unit of the operation display unit.
Figure 7B:
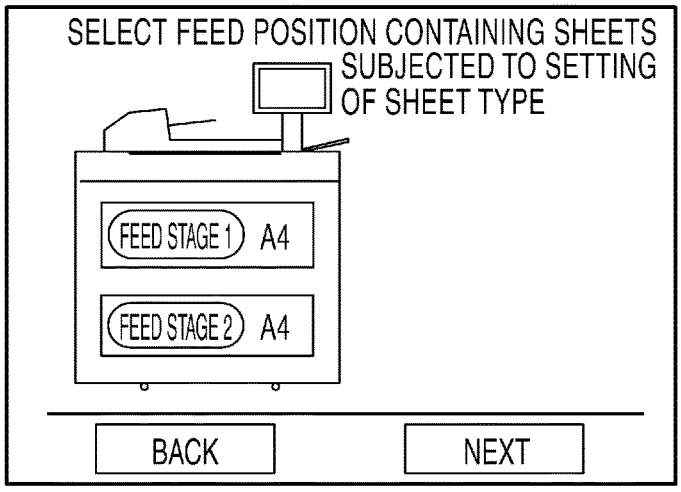

When the user presses a "SHEET SETTING" button displayed on the display unit 420 in the display screen in FIG. 7A, the CPU 901 shifts the display screen to a sheet setting screen shown in FIG. 7B. In the sheet setting screen in FIG. 7B, the user selects a sheet feed position that contains sheets subjected to the sheet setting. For example, a feed stage 1 and feed stage 2 that correspond to the two cassettes provided in the image forming apparatus 100 are displayed on the setting screen. Accordingly, the user selects the feed stage 1 or the feed stage 2. In this example, the user shall select the feed stage 1.

Figure 7C:
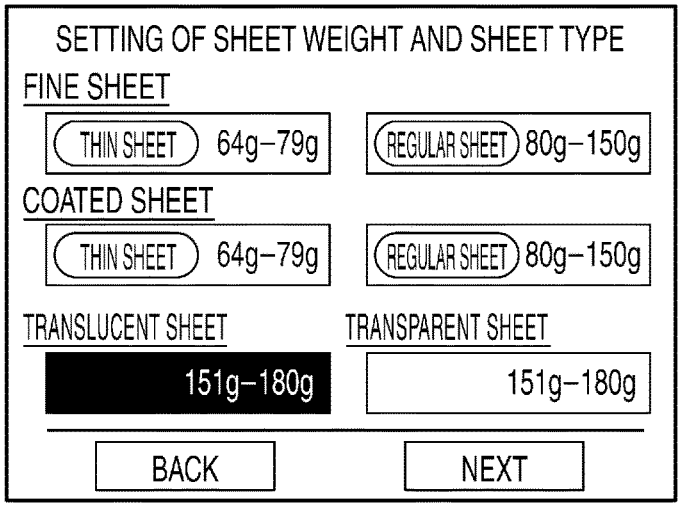
Figure 7D:
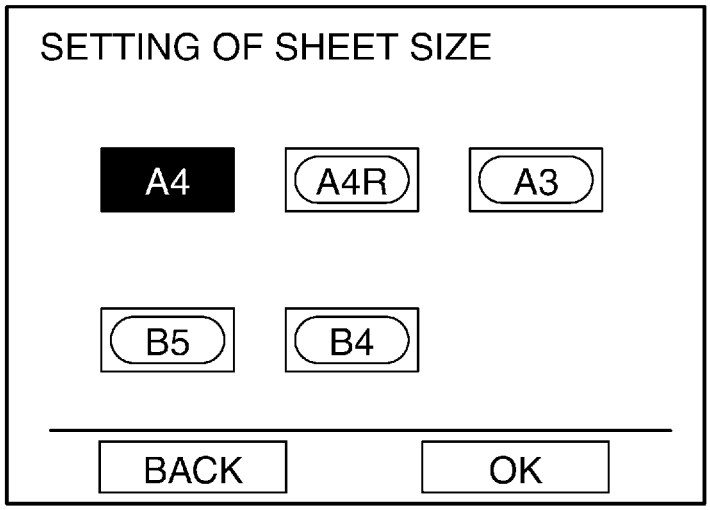
Figure 7E:
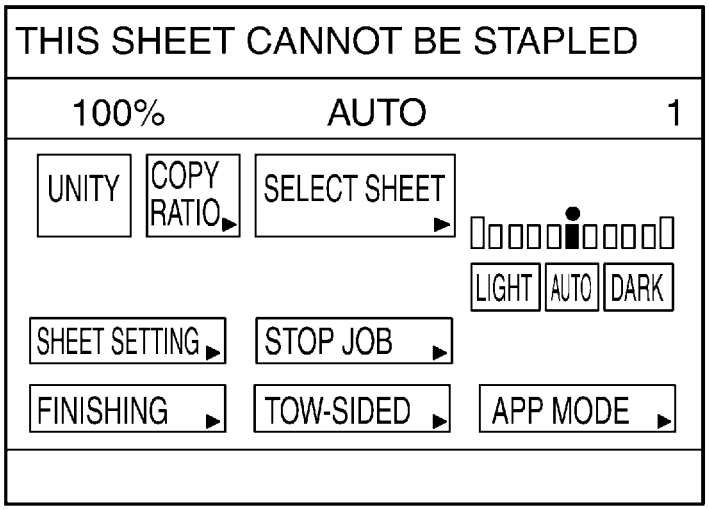

When the user presses a "NEXT" button after selecting the feed stage, the CPU 901 shifts the display screen to a setting screen for basis weight and a sheet type shown in FIG. 7C. When the user presses a "NEXT" in the setting screen for the basis weight and sheet type in FIG. 7C after selecting the basis weight and the sheet type of the sheets set in the sheet container unit, the CPU 901 shifts the display screen to a sheet size setting screen shown in FIG. 7D. When the user presses an "OK" button in the sheet size setting screen in FIG. 7D after selecting the sheet size set to the cassette, the CPU 901 shifts the display screen to the initial screen shown in FIG. 7A, and the sheet registration is finished.

It should be noted that a post-process to a transparent sheet is prohibited in the embodiment. Accordingly, for example, when the user selects a transparent sheet in the display screen in FIG. 7C and the "STAPLE" was selected in FIG. 6B mentioned above, a message showing that a job cannot be performed is displayed on the display screen as shown in FIG. 7E.

The image forming apparatus 100 notifies the finisher 500 of the sheet information set in the display screens FIG. 7A through FIG. 7D through a communication means when the sheet P taken up from the upper cassette 114 or the lower cassette 115 is conveyed to the registration roller pair 126, for example.

FIG. 8 is a view showing a format of the sheet information transmitted from the controller 900 to the finisher control unit 951. As shown in FIG. 8, the sheet information includes a sheet ID, sheet width, sheet length, basis weight, sheet type, and post-process mode information.

Hereinafter, the sheet conveyance process when sheets, such as a regular sheet, coated sheet, and translucent sheet, except a transparent sheet are set through the operation display unit 400 will be described. Since the finisher 500 employs transmission optical sensors, which are difficult to detect a transparent sheet, as the conveyance sensors as mentioned above, a transparent sheet is not subjected to the staple process.

Figure 9A:
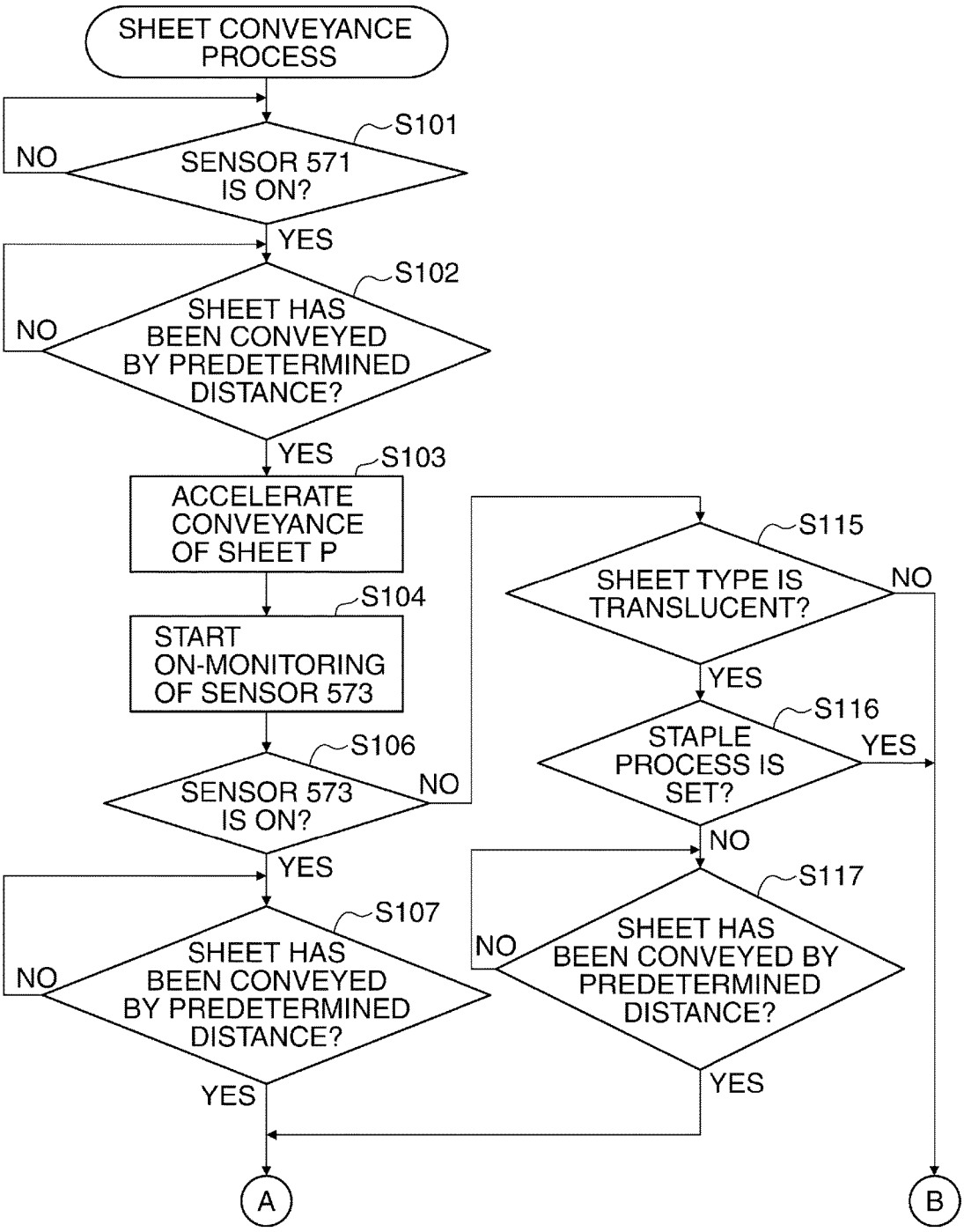
FIG. 9A and FIG. 9B are flowcharts showing procedures of a sheet conveyance process executed by the finisher in FIG. 2.
Figure 9B:
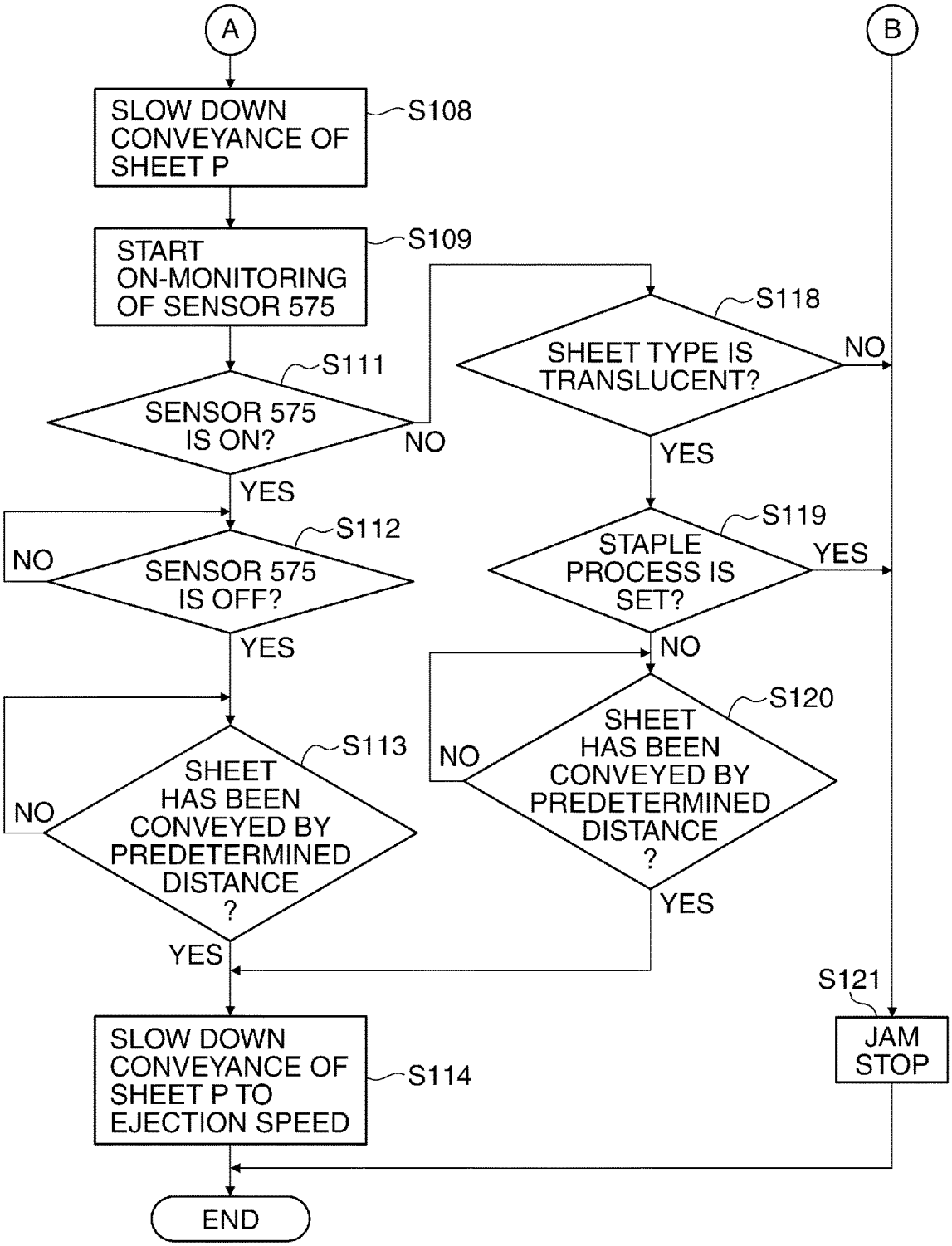

FIG. 9A and FIG. 9B are flowcharts showing procedures of the sheet conveyance process executed by the finisher 500 in FIG. 2. The CPU 952 of the finisher control unit 951 performs this sheet conveyance process according to the program stored in the ROM 953. The sheet conveyance process starts when the conveyance sensor 570 turns ON.

As shown in FIG. 9A, when the sheet conveyance process is started, the CPU 952 determines whether the conveyance sensor 571 detects the sheet P (step S101), and waits until detecting (turning ON). After the conveyance sensor 571 turns ON, the CPU 952 determines whether the operation for conveying the sheet P by a predetermined distance has been performed (step S102), and continues the conveyance until finishing the operation for conveying by the predetermined distance. Next, after the operation for conveying the sheet P by the predetermined distance was completed, the CPU 952 accelerates the entrance motor M1 and the buffer motor M2 to accelerate the conveyance speed of the sheet P by the conveying roller pairs 512, 513, 514, and 516 (step S103). Since the conveyed sheet P is ejected onto the sheet ejection tray 702 at an ejection speed slower than the conveyance speed, an interval to the following sheet may become insufficient at the time of ejection to the sheet ejection tray. Now, since the conveyance speed of the sheet P is accelerated after entering into the finisher 500, a sufficient interval is kept to the following sheet.

After accelerating the conveyance speed of the sheet P (the step S103), the CPU 952 starts to monitor detection of the sheet P by the conveyance sensor 573 (ON monitoring, step S104). After starting to monitor detection of the sheet P by the conveyance sensor 573 (step S104), the CPU 952 determines whether delay jam was detected on the basis of the monitoring result by the conveyance sensor 573. That is, the CPU 952 determines whether the conveyance sensor 573 turns ON after starting the ON monitoring of the conveyance sensor 573, and continues the conveyance of the sheet P until turning ON (step S106). It should be noted that the conveyance sensor 573 is a transmission optical sensor that is difficult to detect a sheet end of a translucent sheet.

As a result of the determination in the step S106, when the conveyance sensor 573 turns ON ("YES" in the step S106), the CPU 952 proceeds with the process to step S107. That is, the CPU 952 determines whether the operation for conveying the sheet P by the predetermined distance has been performed (step S107), and continues the conveyance until finishing the operation for conveying by the predetermined distance.

Next, after performing the operation for conveying the sheet P by the predetermined distance ("YES" in the step S107), the CPU 952 proceeds with the process to step S108 in FIG. 9B. That is, the CPU 952 slows down the buffer motor M2, the ejection motor M3, and the bundle ejection motor M5 to decrease the conveyance speed of the sheet P by the conveying roller pairs 514, 516, 517, 518, and 680 (step S108). If the conveyance of the sheet P continues at the speed accelerated in the step S103, the front end of the sheet P may be lifted up when the front end of the sheet P escapes from the conveying roller 518 because the conveyance speed is high, which may deteriorate stacking property. Accordingly, the conveyance speed is decreased in order to prevent the sheet from lifting up.

Next, the CPU 952 starts to monitor the detection of the sheet P by the conveyance sensor 575 (ON monitoring, step S109). After starting to monitor the detection of the sheet P by the conveyance sensor 575, the CPU 952 determines whether delay jam was detected on the basis of the monitoring result of the conveyance sensor 575. That is, the CPU 952 determines whether the conveyance sensor 575 turns ON after starting the ON monitoring of the conveyance sensor 575, and continues the conveyance of the sheet P until turning ON (step S111). It should be noted that the conveyance sensor 575 is a transmission optical sensor.

As a result of the determination in the step S111, when the conveyance sensor 575 turns ON ("YES" in the step S111), the CPU 952 proceeds with the process to step S112. That is, the CPU 952 determines whether the conveyance sensor 575 turns OFF, and continues the conveyance of the sheet P at the constant speed until turning OFF (step S112).

Next, when the conveyance sensor 575 turns OFF ("YES" in the step S112), the CPU 952 proceeds with the process to step S113. That is, the CPU 952 determines whether the operation for conveying the sheet P by the predetermined distance has been performed (step S113), and continues the conveyance of the sheet P until finishing the operation for conveying by the predetermined distance.

Next, when the operation for conveying the sheet P by the predetermined distance is completed ("YES" in the step S113), the CPU 952 proceeds with the process to step S114. That is, the CPU 952 slows down the bundle ejection motor M5 so that the conveyance speed of the sheet P becomes the ejection speed (step S114). The conveyance speed of the sheet P is slowed down on the basis of the detection result of the conveyance sensor 575, i.e., after the conveyance sensor 575 detects the sheet end of the sheet P (step S112). Since the sheet P is slowed down to the ejection speed, the lifting up of the sheet P is prevented, and the sheet is ejected satisfactorily onto the sheet ejection tray 702. Then, the CPU 952 finishes the sheet conveyance process.

On the other hand, as a result of the determination in the step S106, when the turning ON of the conveyance sensor 573 is not detected even if the sheet P has been conveyed by the predetermined distance after starting the ON monitoring of the conveyance sensor 573 ("NO" in the step S106), the CPU 952 proceeds with the process to step S115. That is, the CPU 952 determines whether the sheet type of the sheet P is a translucent sheet (the step S115). At this time, the CPU 952 refers to the sheet information about the sheet P stored in the RAM 954.

As a result of the determination in the step S115, when the sheet type is the translucent sheet ("YES" in the step S115), there is a possibility that the conveyance sensor 573 could not detect the sheet P because of high transmittance. In this case, the CPU 952 determines whether the staple process is set to the sheet P (step S116). At this time, the CPU 952 refers to the post-process information about the sheet P that is input and stored in the RAM 954. As a result of the determination in the step S116, when the staple process is not set ("NO" in the step S116), the CPU 952 proceeds with the process to step S117. That is, the CPU 952 determines whether the operation for conveying the sheet P by the predetermined distance has been performed (the step S117), and proceeds with the process to step S108 after completing the operation for conveying by the predetermined distance.

On the other hand, as a result of the determination in the step S115, when the sheet type is not a translucent sheet (for example, when the sheet type is a regular paper or coated sheet that the sensor 573 is able to detect a sheet end, "NO" in the step S115), the CPU 952 proceeds with the process to step S121 in FIG. 9B. That is, since there is a high possibility that the delay jam occurs because the sheet P has not reached the conveyance sensor in this case, the CPU 952 stops conveyance of the sheet P (the step S121). As a result of the determination in the step S116, when the staple process is set ("YES" in the step S116), the CPU 952 proceeds with the process to the step S121 and stops conveyance of the sheet P.

Moreover, as a result of the determination in the step S111, when the conveyance sensor 575 does not detect a sheet even if the sheet has been conveyed by the predetermined distance after starting the monitoring of the conveyance sensor 575 ("NO" in the step S111), the CPU 952 proceeds with the process to step S118. That is, the CPU 952 determines whether the sheet type of the sheet P is a translucent sheet (the step S118). At this time, the CPU 952 refers to the sheet information about the sheet P that is input and stored in the RAM 954.

As a result of the determination in the step S118, when the sheet type is the translucent sheet ("YES" in the step S118), there is a possibility that the conveyance sensor 575 could not detect the sheet P because of high transmittance of the translucent sheet. In this case, the CPU 952 determines whether the staple process is set to the sheet P (step S119). At this time, the CPU 952 refers to the post-process information about the sheet P stored in the RAM 954. As a result of the determination in the step S119, when the staple process is not set ("NO" in the step S119), the CPU 952 proceeds with the process to step S120. That is, the CPU 952 determines whether the operation for conveying the sheet P by the predetermined distance has been performed (the step S120), and proceeds with the process to step S114 after completing the operation for conveying by the predetermined distance.

On the other hand, as a result of the determination in the step S118, when the sheet type is not a translucent sheet (for example, when the sheet type is a regular sheet or a coated sheet that the sensor 575 is able to detect a sheet end, "NO" in the step S118), the CPU 952 proceeds with the process to the step S121. That is, since there is a high possibility that the delay jam occurs because the sheet P has not reached the conveyance sensor in this case, the CPU 952 stops conveyance of the sheet P (the step S121). As a result of the determination in the step S119, when the staple process is set ("YES" in the step S119), the CPU 952 proceeds with the process to the step S121, and stops conveyance of the sheet P.

According to the process in FIG. 8, the conveyance of a sheet continues in the conveyance process for a translucent sheet when the staple process is not set even if the conveyance sensor 573 or 575 cannot detect the sheet end of the sheet P. As a result of this, the conveyance process is facilitated.

In the embodiment, when the user selects the sorting process to the A4 translucent sheet as the sheet process, and even when the conveyance sensors cannot detect the sheet end because of the high transmittance of the sheet selected as the processing target, the conveyance of the sheet P continues as long as the staple is not set as the post-process ("NO" in the step S116 or S119). This prevents the wasteful result from generating by performing the staple process to an irregular sheet bundle beforehand.

In the embodiment, the finisher 500 has the plurality of conveyance sensors, and at least one of the plurality of sensors is a transmission optical sensor. Specifically, the conveyance sensors 572, 573, and 575 are the transmission optical sensors that are difficult to detect the sheet end of the translucent sheet. On the other hand, the conveyance sensors 570, 571, 574, and 576 are sensors that are able to detect the sheet end of the translucent sheet, and are flag sensors, for example.

In the embodiment, when the sorting process that sorts the sheets P by a predetermined number of sheets is performed and when the staple process is not performed, the conveyance of the sheets P is continued without being stopped.

In the embodiment mentioned above, when a conveyance sensor cannot detect a translucent sheet, the conveyance is continued as long as the staple process is not set. The control similar to the staple process is able to perform to processes other than the staple process that need positioning of a sheet, such as a punching process that makes a hole in a sheet and a scoring process that forms a score on a sheet in order to facilitate folding.

Next, a transparent sheet conveyance process corresponding to the sheet conveyance process in FIG. 9 will be described as a reference example.

Figure 10:
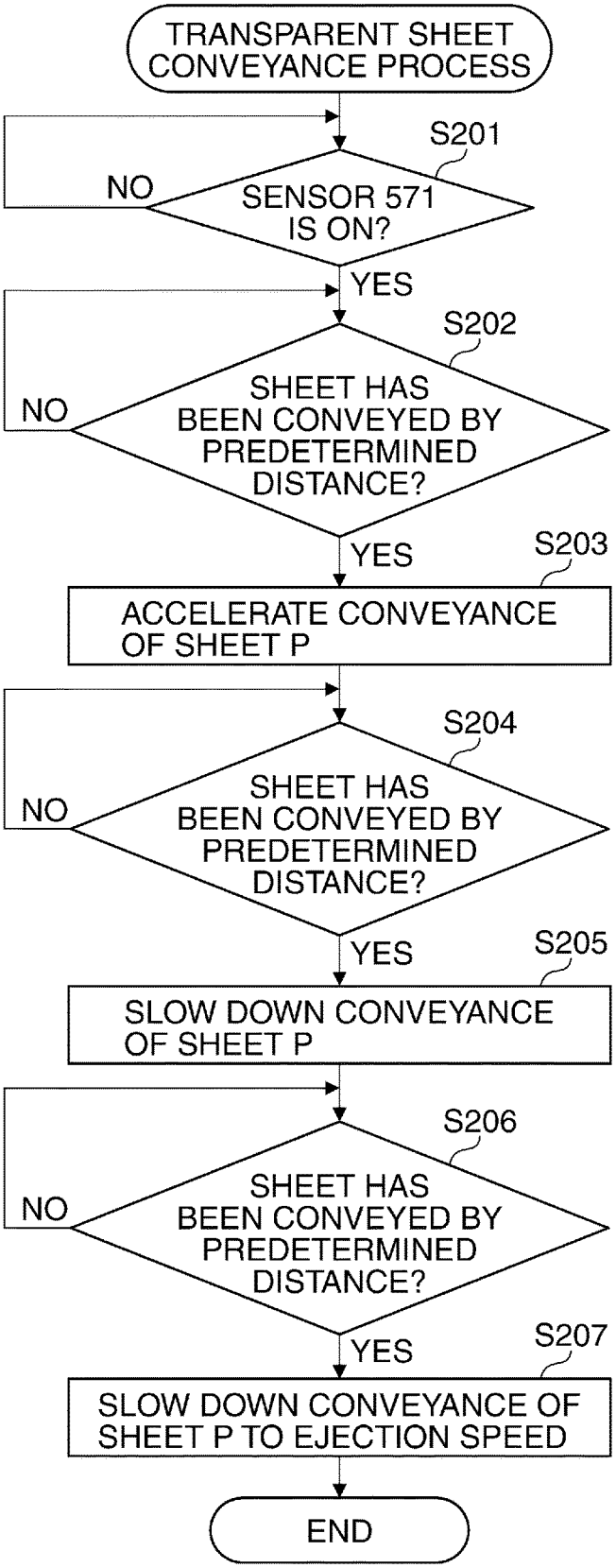
FIG. 10 is a flowchart showing procedures of a transparent sheet conveyance process executed by the finisher in FIG. 2.

FIG. 10 is a flowchart showing procedures of the transparent sheet conveyance process executed by the finisher in FIG. 2. This transparent sheet conveyance process is executed by the CPU 952 of the finisher 500 according to a transparent-sheet-conveyance-process program stored in the ROM 953 when the transparent sheet is set through the operation display unit 400. The transparent sheet conveyance process starts when the conveyance sensor 570 turns ON.

As shown in FIG. 10, the transparent sheet conveyance process is started, the CPU 952 determines whether the conveyance sensor 571 turns ON (step S201), and waits until turning ON. After the conveyance sensor 571 turns ON, the CPU 952 determines whether the operation for conveying the sheet P by the predetermined distance has been performed (step S202), and continues the conveyance until completing the operation for conveying by the predetermined distance. After the operation for conveying the sheet P by the predetermined distance was performed, the CPU 952 accelerates the entrance motor M1 and the buffer motor M2 to accelerate the conveyance speed of the sheet P by the conveying roller pairs 512, 513, 514, and 516 (step S203).

After accelerating the conveyance speed of the sheet P (step S203), the CPU 952 determines whether the operation for conveying the sheet P by the predetermined distance has been performed (step S204), and continues the conveyance operation until the operation is completed. After the operation for conveying the sheet P by the predetermined distance was performed, the CPU 952 slows down the buffer motor M2, the ejection motor M3, and the bundle ejection motor M5 to decrease the conveyance speed of the sheet P by the conveying roller pairs 514, 516, 517, 518, and 680 (step S205).

Next, the CPU 952 determines whether the operation for conveying the sheet P by the predetermined distance has been performed (step S206), and continues the conveyance operation until the operation is completed. After the operation for conveying the sheet P by the predetermined distance was performed, the CPU 952 slows down the bundle ejection motor M5 to slow down the conveyance speed of the sheet P to the ejection speed (step S207), and finishes conveyance of the sheet P. The sheet P is ejected onto the sheet ejection tray 702 at the ejection speed after that.

According to the process in FIG. 10, the transparent sheet is also conveyed satisfactorily and ejects onto the sheet ejection tray 702. When a transparent sheet is conveyed, the conveyance speed of the sheet P is not accelerated and slowed down on the basis of the detection result of the conveyance sensors because there are the conveyance sensors that cannot detect a sheet end as described with reference to FIG. 5.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-147674, filed Jul. 27, 2015, which is hereby incorporated by reference herein in its entirety.

What is claimed is:

1. A sheet processing apparatus comprising:

a conveyance unit configured to convey a sheet from an image forming apparatus along a conveyance path, the sheet being a first type of sheet or a second type of sheet that is higher in transmittance than the first type of sheet;

an optical sensor provided on the conveyance path and configured to detect the sheet during conveyance;

an alignment unit configured to align the sheet conveyed by the conveyance unit based on detection information about the sheet detected by the optical sensor;

a post-process unit capable of performing a post-process to the sheet aligned by the alignment unit;

an input unit configured to input post-process information indicating whether or not the post-process unit performs the post-process to the sheet; and a control unit configured to control, in a case where the optical sensor does not detect the sheet during conveyance within a predetermined time period and the sheet corresponds to the second type of sheet, the conveyance unit to stop conveyance of the sheet based on the post-process information input with the input unit, wherein the control unit is configured to control, in a case where the optical sensor does not detect the sheet during conveyance within the predetermined time period and the sheet corresponds to the first type of sheet, the conveyance unit to stop conveyance of the sheet regardless of the post-processing information input with the input unit.

2. The sheet processing apparatus according to claim 1, wherein the second type sheet is a translucent sheet.

3. The sheet processing apparatus according to claim 1, wherein the optical sensor does not detect an end of the sheet when the sheet comprises an OHP sheet instead of the first type sheet and the second type sheet.

4. The sheet processing apparatus according to claim 1, wherein the conveyance unit accelerates and slows down the conveyance speed of the sheet based on information detected by the optical sensor.

5. The sheet processing apparatus according to claim 1, wherein the post-process is a binding process that binds a sheet bundle that consists of a plurality of sheets.

6. The sheet processing apparatus according to claim 1, wherein the post-process is a punching process that makes a hole in a sheet.

7. The sheet processing apparatus according to claim 1, wherein the post-process is a scoring process that forms a score on a sheet for folding.

8. The sheet processing apparatus according to claim 1, wherein the post-process is a sorting process that sorts sheets by a predetermined number of sheets.

9. The sheet processing apparatus according to claim 1, wherein the optical sensor is a transmission optical sensor.

10. The sheet processing apparatus according to claim 1, further comprising a flag sensor that is provided on the conveyance path and detects a sheet during conveyance, wherein the control unit controls the conveyance unit so as to stop conveyance of the sheet regardless of the sheet information input with the input unit when the flag sensor cannot detect the sheet during conveyance.

11. The sheet processing apparatus according to claim 1, further comprising a tray to which a sheet is ejected, wherein a sheet is ejected to said tray without performing the post-process when the control unit continues the conveyance operation for the sheet concerned.

12. An image forming system comprising:

an image forming apparatus configured to form an image on a sheet; and a sheet processing apparatus configured to perform a post-process to the sheet, the sheet processing apparatus comprising:

a conveyance unit configured to convey the sheet from the image forming apparatus along a conveyance path, the sheet being a first type of sheet or a second type of sheet that is higher in transmittance than the first type of sheet;

an optical sensor provided on the conveyance path and configured to detect the sheet during conveyance;

an alignment unit configured to align the sheet conveyed by the conveyance unit based on detection information about the sheet detected by the optical sensor;

a post-process unit capable of performing a post-process to the sheet aligned by the alignment unit;

an input unit configured to input post-process information indicating whether or not the post-process unit performs the post-process to the sheet; and a control unit configured to control, in a case where the optical sensor does not detect the sheet during conveyance within a predetermined time period and the sheet corresponds to the second type of sheet, the conveyance unit to stop conveyance of the sheet based on the post-process information input with the input unit, wherein the control unit is configured to control, in a case where the optical sensor does not detect the sheet during conveyance within the predetermined time period and the sheet corresponds to the first type of sheet, the conveyance unit to stop conveyance of the sheet regardless of the post-processing information input with the input unit.

* * * * *